US012085375B2

(12) United States Patent
Scherge et al.

(10) Patent No.: US 12,085,375 B2
(45) Date of Patent: Sep. 10, 2024

(54) TEST AND/OR PRACTICE AMMUNITION

(71) Applicant: Rheinmetall Waffe Munition GmbH, Unterlüß (DE)

(72) Inventors: Wolfgang Scherge, Südheide (DE); Stefan Keil, Walsrode (DE); Thomas Heitmann, Unterlüß (DE); Tobias Schmidt, Hamburg (DE); Hendrik Radies, Hermannsburg (DE)

(73) Assignee: Rheinmetall Waffe Munition GmbH, Unterlüß (DE)

( * ) Notice: Subject to any disclaimer, the term of this patent is extended or adjusted under 35 U.S.C. 154(b) by 0 days.

(21) Appl. No.: 17/296,677

(22) PCT Filed: Nov. 11, 2019

(86) PCT No.: PCT/EP2019/080782
§ 371 (c)(1),
(2) Date: May 25, 2021

(87) PCT Pub. No.: WO2020/108962
PCT Pub. Date: Jun. 4, 2020

(65) Prior Publication Data

US 2022/0026186 A1 Jan. 27, 2022

(30) Foreign Application Priority Data

Nov. 26, 2018 (DE) ..... 10 2018 129 786.6

(51) Int. Cl.
*F42B 8/16* (2006.01)
*F42B 8/14* (2006.01)
(Continued)

(52) U.S. Cl.
CPC ..... *F42B 8/14* (2013.01); *F42B 8/16* (2013.01); *F42B 10/14* (2013.01); *F42B 35/00* (2013.01);
(Continued)

(58) Field of Classification Search
None
See application file for complete search history.

(56) References Cited

U.S. PATENT DOCUMENTS 3,019,733 A * 2/1962 Braid ..... F42B 8/08 29/521
3,064,577 A * 11/1962 Brandt ..... F42B 8/18 102/529
(Continued)

FOREIGN PATENT DOCUMENTS

DE 8814130 U1 4/1990
DE 4336808 A1 5/1995
(Continued)

OTHER PUBLICATIONS

International Search Report from corresponding PCT Application PCT/EP2019/080782, dated Feb. 14, 2019; ISA/EP (5 pages).
(Continued)

*Primary Examiner* — Derrick R Morgan
(74) *Attorney, Agent, or Firm* — Harness, Dickey & Pierce, P.L.C.

(57) ABSTRACT

The invention relates to a test and/or practice ammunition having at least one projectile with a projectile head and a fin which can be found at the end of the projectile for example or a projectile with a projectile base and a projectile ogive. A cartridge shell is used to receive a drive and has a shell base, wherein an interface is attached in or on the shell base. The test and/or practice ammunition is characterized by a programmable fuze which is arranged in the projectile head or the projectile ogive. The projectile head/projectile ogive is equipped with at least one fuze amplifier and an electronic fuze system and optionally a separating charge.

10 Claims, 2 Drawing Sheets

(51) Int. Cl.

| | |
|---|---|
| ***F42B 10/14*** | (2006.01) |
| ***F42B 35/00*** | (2006.01) |
| ***F42C 11/06*** | (2006.01) |
| ***F42C 19/06*** | (2006.01) |
| ***F42C 21/00*** | (2006.01) |
| *F42C 17/04* | (2006.01) |

(52) U.S. Cl.
CPC ..... *F42C 11/065* (2013.01); *F42C 19/06* (2013.01); *F42C 21/00* (2013.01); *F42C 17/04* (2013.01)

(56) References Cited

U.S. PATENT DOCUMENTS 3,094,934 A * 6/1963 Anthony ..... F42B 12/40 102/513
3,289,588 A * 12/1966 Hitchens ..... F42B 12/48 102/513
3,291,049 A * 12/1966 Hitchens ..... F42B 12/40 102/513
3,292,543 A * 12/1966 Tisch ..... F42B 12/48 102/334
3,361,066 A * 1/1968 Gawlick ..... F42B 12/38 102/513
3,422,764 A * 1/1969 Kaiser ..... F42C 9/16 102/233
3,667,395 A * 6/1972 Romer ..... F42B 8/14 102/529
3,811,381 A * 5/1974 Fichter, Jr. ..... F42B 12/48 102/513
4,043,268 A * 8/1977 Fischer ..... F42B 12/48 102/364
4,218,976 A * 8/1980 Luebbers ..... F42B 12/48 102/498
4,227,460 A * 10/1980 Krone ..... F42B 12/48 102/513
4,535,698 A * 8/1985 Yuen ..... F42B 8/14 102/521
4,549,487 A * 10/1985 Jensen ..... F42B 10/48 102/498
4,711,180 A * 12/1987 Smolnik ..... F42B 8/10 102/498
4,974,515 A * 12/1990 Busch ..... F42B 12/14 102/501
5,014,062 A * 5/1991 Schriner ..... F42B 12/40 102/210
5,147,973 A * 9/1992 Ziemba ..... F42C 9/148 102/214
5,228,855 A * 7/1993 Frost ..... F42B 30/12 102/373
5,317,975 A * 6/1994 Sauvestre ..... F42B 12/62 102/357
5,817,969 A * 10/1998 Ettmuller ..... F42B 12/60 102/494
6,059,573 A * 5/2000 Patel ..... F41G 3/30 434/18
6,216,595 B1 * 4/2001 Lamorlette ..... G01P 3/665 102/270
6,374,741 B1 * 4/2002 Stanley ..... F42C 17/04 102/439
6,523,478 B1 * 2/2003 Gonzalez ..... F42B 30/04 42/105
6,688,032 B1 * 2/2004 Gonzalez ..... F42B 30/04 42/105
6,955,125 B1 * 10/2005 Mazzei ..... F42B 12/48 102/444
7,475,625 B1 * 1/2009 Niemeyer ..... F42C 19/06 89/6
8,220,392 B1 * 7/2012 Maldonado ..... F42B 30/12 42/105
8,607,708 B1 * 12/2013 McClenahan ..... F42B 12/40 102/500
8,985,025 B1 * 3/2015 Manz ..... F42C 9/14 102/489
9,194,675 B1 * 11/2015 Manole ..... F42B 8/20
9,448,047 B1 * 9/2016 Domanico ..... F42B 27/00
9,500,454 B1 * 11/2016 Decker ..... F42B 10/56
9,513,094 B2 * 12/2016 Dierks ..... F42C 19/00
10,352,655 B2 * 7/2019 Reymann ..... F41G 3/30
10,408,586 B1 * 9/2019 DeAngelis ..... F42B 12/74
10,408,590 B1 * 9/2019 Campagnuolo ..... F42B 12/44
10,900,761 B2 * 1/2021 Blache ..... F42B 33/0207
10,907,935 B2 * 2/2021 Armstrong ..... F41A 33/00
2002/0088897 A1 * 7/2002 Davis ..... F42B 10/06 244/3.24
2002/0108525 A1 * 8/2002 Heitmann ..... F42B 5/02 102/472
2004/0159261 A1 * 8/2004 Steele ..... F42B 12/58 102/477
2004/0163564 A1 * 8/2004 Sutcliffe ..... F42C 11/065 102/266
2007/0245920 A1 * 10/2007 Henriksson ..... F42B 12/382 102/529
2008/0223977 A1 * 9/2008 Dryer ..... F42B 10/14 244/3.22
2010/0294160 A1 * 11/2010 Baumann ..... F42B 12/625 102/493
2011/0017864 A1 * 1/2011 Roemerman ..... F42C 15/20 244/3.16
2011/0023743 A1 * 2/2011 Heitmann ..... F42B 12/16 102/491
2011/0088582 A1 * 4/2011 Bippes ..... F42B 12/62 102/356
2011/0180654 A1 * 7/2011 Thiesen ..... F42B 10/64 244/3.14
2012/0180685 A1 * 7/2012 O ..... F42B 8/14 102/334
2012/0181375 A1 * 7/2012 Dryer ..... F42B 10/661 244/3.22
2015/0308803 A1 * 10/2015 Caillaut ..... F42B 12/64 102/506
2016/0010966 A1 * 1/2016 Reijo ..... F42B 8/14 102/477
2018/0209771 A1 * 7/2018 Guth ..... F42B 12/48
2018/0364006 A1 * 12/2018 Reymann ..... G01S 19/13
2020/0124385 A1 * 4/2020 Mercier ..... F42B 12/22
2020/0208951 A1 * 7/2020 Allison ..... F42B 12/32
2020/0309494 A1 * 10/2020 Perrot ..... F42B 12/48
2021/0318106 A1 * 10/2021 Bruno ..... F42B 8/14
2023/0194226 A1 * 6/2023 Longo ..... F21K 2/06 102/513

FOREIGN PATENT DOCUMENTS

DE 196 09 012 A1 9/1997
DE 10102624 A1 7/2002
DE 10 2005 030 263 B3 11/2006
DE 102011107960 B3 3/2012
EP 2 959 261 A1 12/2015
FR 2538892 A1 * 7/1984 ..... F42B 12/40

OTHER PUBLICATIONS

Office Action from corresponding Canadian Patent Application No. 3,121,100, dated Aug. 21, 2023.

* cited by examiner

TEST AND/OR PRACTICE AMMUNITION

CROSS-REFERENCE TO RELATED APPLICATIONS

This application is a national phase application of PCT Application No. PCT/EP2019/080782, filed on 11 Nov. 2019, which claims the benefit of and priority to German Patent Application No. 10 2018 129 786.6, filed on 26 Nov. 2018. The entire disclosures of the applications identified in this paragraph are incorporated herein by references.

FIELD

The invention relates to the development and testing of fuzes. In particular, the invention relates to a test ammunition or a test cartridge which can also be used as a practice ammunition or a practice cartridge.

BACKGROUND

When developing and testing an ammunition fuze, conventional combat ammunition is currently used. The occurrence of possible duds in the testing phase is associated therewith. When using combat ammunition, however, despite the functional reliability achieved, dangerous duds can occur, which significantly disrupt the test operation. In particular, these can represent a source of danger until they are destroyed.

The object of the invention is to provide, in particular, a test ammunition with which the function of a programmed fuze can be demonstrated.

The object is achieved by the features of claim 1. Advantageous embodiments can be found in the dependent claims.

DE 10 2011 107 960 B3 discloses ammunition, in particular practice ammunition which can be fired from handguns, which comprises a projectile body having a projectile shell. The projectile body contains a charge that can preferably explode in the air. In order to ensure that the marking of an air blast point or, if desired, an impact point of the projectile body is clearly visible in the target over a longer period of time, it is proposed to use a marker to mark the air explosion point or the impact point. For this purpose, the projectile shell comprises a centrally arranged cylindrical block with a charge space containing a charge. The cylindrical block has at least one pressure relief bore extending radially from the charge space to the outer circumference of the cylindrical block. The outer circumference of the cylindrical container is surrounded by an annular container having the marker. Before or when firing the practice ammunition, a time fuze arranged on the base of the ammunition is programmed in such a way that the charge is already ignited before the projectile body hits a target. After igniting the charge, the active gas pressure dismantles the container with the marker and the projectile shell. The marker is deployed from the projectile body. In addition, a bang and/or flash can be produced when the air blast point is reached.

SUMMARY

The present invention is based on the idea of developing, in particular, test ammunition without a dangerous main charge in order to significantly reduce the hazard posed by a dud.

The inexpensive, programmable test ammunition is primarily used for the development of fuzes for live ammunition. This test ammunition is characterized by the fact that it causes a type of detonation at the programmed air blast point or at/in the target. This type of detonation has the effect that parts of a projectile of the ammunition can separate from one another. As a result of this separation, a visible signal can be transmitted. An evaluation of the function of the fuze for a crew can take place by means of the visualization. The test ammunition can also be used as practice ammunition or vice versa. This results in test ammunition that can also be used as practice ammunition. The proposed test and/or practice ammunition can be used to detect and display correct or incorrect operation of the fuze during testing and correct or incorrect operation of a weapon system during practice.

The programmable fuze preferably contains all fuze functions of live combat ammunition. In this way, it can be achieved that the operation of the weapon system by a crew can proceed in the same way as with live, for example HE combat ammunition. All scenarios and operations on the weapon system, for example a tank, can thus be practiced realistically.

The test and/or practice ammunition comprises a drive, a projectile, comprising at least one projectile head or a projectile ogive. At least one fuze that can be programmed is contained in the projectile head or in the projectile ogive. The projectile head/projectile ogive can optionally contain an additional separating charge.

Depending on the type of ammunition, the projectile can have a fin at the rear. At least this fin should be detachable or separable from the projectile head so that the projectile can be separated into at least two parts. However, it is also possible to divide it into a plurality of parts. The fin itself can be folded out.

If the projectile does not have a fin, it must be provided that the projectile itself can be separated into at least two parts. There could be a separation point between a projectile base (rear) and a projectile ogive. The division into a plurality of parts can also be provided in this case.

A data transmission to the projectile head is integrated in the ammunition drive or in an ammunition shell of the ammunition. A selected blast point of the projectile body can be programmed. The fuze initiates a projectile separation at the programmed blast point, during a target impact or with a delay after a target impact.

The programming of the test and/or practice ammunition takes place in the weapon system or through the weapon system according to a target selection. Thereafter, the test and/or practice ammunition is ignited and the projectile leaves the weapon barrel of the weapon system. The weapon system can be a larger caliber weapon attached on a vehicle such as a tank. However, the solution is not limited to this caliber.

After firing the ammunition, as is the case with an original fuze system for combat ammunition, an "impact" at the target (e.g., ground impact, impact on a target, etc.) is detected by the fuze. Ignition is triggered when detecting an impact. The triggering of the ignition takes place by the fuze's electronic system either on the basis of the programmed blast point at the target or the detected projectile impact in the target. The igniter preferably has a fuze amplifier. This can also ignite an additional separating charge, if necessary. With the ignition, the desired separation takes place, e.g. the separation of the projectile base from the projectile ogive or the fin from the projectile head.

With the ignition, a pyrotechnic integrated in the projectile head or the projectile ogive can also be ignited and released. This pyrotechnic produces, for example, a visible light and/or smoke signal. This signal is used in particular to make the position of the programmed blast point in the target area or on the target itself visible or recognizable when the projectile is separated on the trajectory and to provide evidence of an assessment of the proper functioning of the fuze. The function of the fuze and the correct or incorrect position of the programmed blast point can be recognized from the position of the visible signal.

A test and/or practice ammunition is therefore proposed. This ammunition has at least one projectile with a projectile head. At the end, the projectile comprises a projectile base or a fin that can be separated from the projectile head. A person skilled in the art knows alternative separation points on the projectile.

This test and/or practice ammunition is characterized by a programmable fuze arranged in the projectile head/projectile ogive. The igniter has at least one fuze amplifier. A cartridge shell for the test and/or practice ammunition is used to receive the drive and has a shell base. An interface is attached to or accommodated in this shell base. The fuze comprises an electronic fuze system with at least one programming and storage unit. Any additional separating charge can be triggered by the electronic fuze system. This separating charge supports the separating process.

For example, a blast point and/or a target impact can be programmed in the fuze or in the electronic fuze system.

In a further development of the invention, the projectile additionally comprises a pyrotechnic for producing a visible signal. The visible signal can be a light and/or smoke signal. This pyrotechnic can be ignited by the fuze amplifier or, if necessary, the additional separating charge. The pyrotechnic is preferably arranged in the region of the separation point(s) provided on the projectile.

The advantage of this programmable test and/or practice ammunition is that the projectile of this test and/or practice ammunition contains only small amounts of explosives, which now also avoids fully-live duds that are dangerous for testing and training purposes. In addition, the costs of a test and/or practice ammunition of this type are lower than that of combat ammunition. There is the possibility of realistically designing the operation of a vehicle or a weapon system by a crew. An important benefit, however, is that collateral damage is avoided.

BRIEF DESCRIPTION OF THE DRAWINGS

The invention will be explained in more detail in the drawings on the basis of one embodiment. In the drawings.

DETAILED DESCRIPTION

Figure 1:
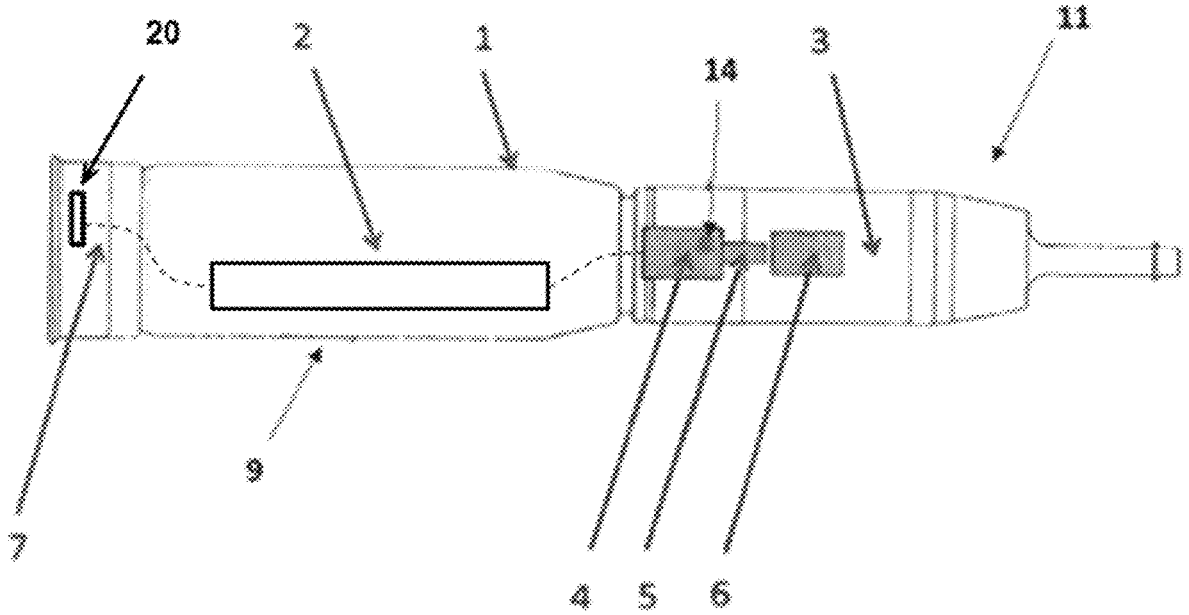
FIG. 1 shows a programmable test and/or practice ammunition.

In FIG. 1, 1 denotes a test and/or practice ammunition (cartridge) which comprises a drive 2 and a projectile 11 with a projectile head 3. The drive 2 is accommodated in a cartridge shell 9 which has a shell base 7. In or on the shell base 7, an interface 20 (not shown in detail) is arranged that is used for data transmission between a weapon system 10 and the projectile head 3 (e.g., shown by dashed lines via the interface 20 and the drive 2). Data transmission within the drive 2, i.e. from the interface to the projectile head 3, is ensured.

Figure 2:
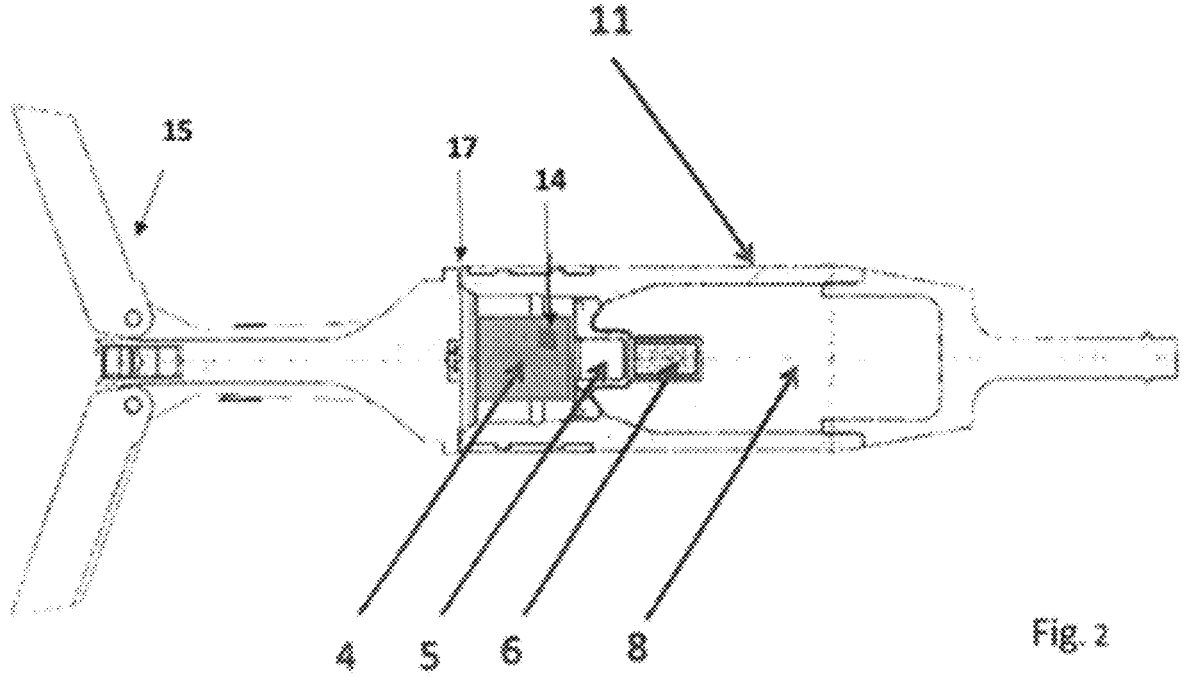
FIG. 2 shows an internal structure of a projectile of the test and/or practice ammunition.

A programmable fuze 4 is arranged in the projectile head 3. The fuze 4 preferably comprises a fuze amplifier 5. The fuze amplifier serves to trigger a projectile separation at at least one separation point 17 (FIG. 2). The projectile head 3 can optionally have an additional separating charge 6 (FIG. 2). Furthermore, there is an electronic fuze system 14 in the projectile head 3, which can trigger the fuze 4. Furthermore, the projectile head 3 should have an inert material 8 (FIG. 2) for damming.

In this embodiment, the projectile 11 has a fin 15 which can be folded out in this case, but is not limited to this embodiment. According to this embodiment, the fin 15 forms the at least one separation point 17 on/in the projectile 11.

The function is explained in more detail with reference to FIGS. 3 and 4:

In the weapon system 10, the fuze 4 is programmed in accordance with the target selection. The programming interface is the interface 20 contained in/on the shell base 7. The programmed data are then stored in the electronic fuze system 14. This can be a selected, programmed blast point 16 on a trajectory of the projectile 11.

Figure 3:
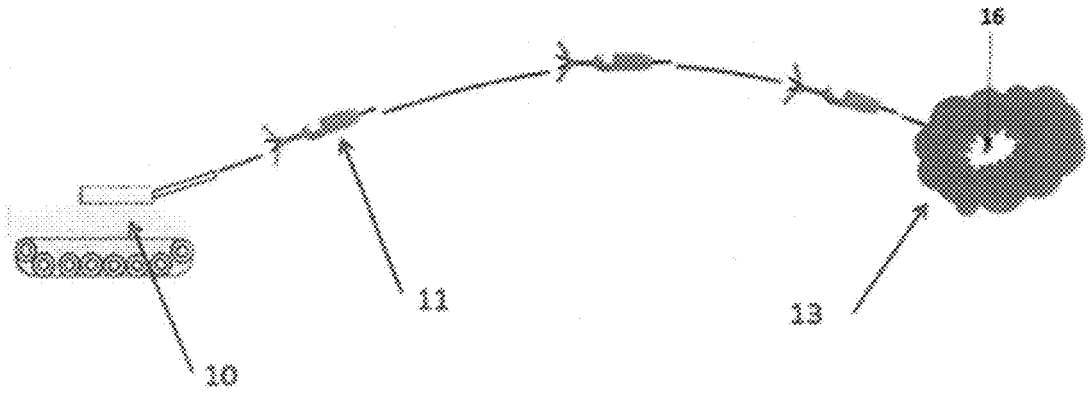
FIG. 3 is a representation of an air blast point of the programmable test and/or practice ammunition.
Figure 4:
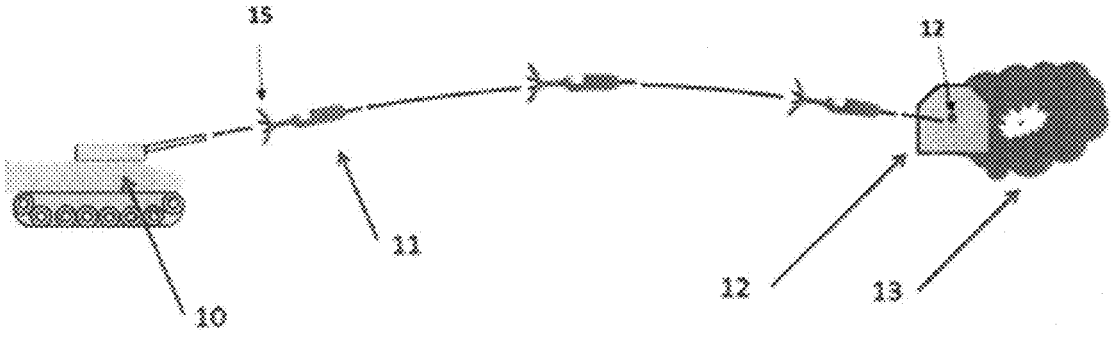
FIG. 4 is a representation of a target impact of the programmable test and/or practice ammunition.

When the selected, programmed blast point 16 according to FIG. 3 is reached, the ignition is triggered by the electronic fuze system 14. When triggering the fuze 4, the at least one separation of the projectile 11 takes place. Even with a target impact 12 according to FIG. 4, for example on a target or a floor surface, the ignition is triggered by the electronic fuze system 14.

The separation can be realized for example by separating the fin 15 from the projectile head 3 at the at least one separation point 17. At the same time, a visible light and/or smoke signal 13, for example, can be transmitted. By transmitting the visible light and/or smoke signal 13, the function of the fuze 4 can be detected or recognized. In addition, the incorrect or correct position of the programmed blast point 16 in the target area can also be recognized by an operator or a crew. A pyrotechnic used for this purpose is preferably introduced or arranged in the region of the at least one separation point 17.

What is claimed is:

1. A test and/or practice ammunition comprising:

a cartridge shell with a drive received therein, and a communication interface attached to or accommodated in a shell base of the cartridge shell; and at least one projectile coupled to the cartridge shell, the at least one projectile with a projectile head or a projectile ogive, wherein:

a programmable fuze is arranged in the projectile head or in the projectile ogive, said programmable fuze comprising a fuze amplifier and an electronic fuze controller in communication with the communication interface;

the projectile further includes a periphery defining a cavity;

a pyrotechnic configured to generate a visible signal, a separating charge, and an inert material for damming;

the inert material is positioned within the cavity and surrounds the separating charge; and the electronic fuze controller is configured to receive data specific to a programmed air blast point or at/in a programmed target from the communication interface such that a data transmission between the communication interface and the electronic fuze controller is within the cartridge shell, and trigger the programmable fuze, such that the projectile separates into two or more parts, and the pyrotechnic and the separating charge are ignited, once the projectile has reached the programmed air blast point or at/in the programmed target.

2. The test and/or practice ammunition according to claim 1, wherein the blast point and/or the target is programmable in the electronic fuze controller.

3. The test and/or practice ammunition according to claim 2, wherein when the blast point and/or the target is detected by the electronic fuze controller, ignition is triggered.

4. The test and/or practice ammunition according to claim 1, wherein the cartridge shell includes a shell base, and wherein the communication interface is mounted in or on the shell base.

5. The test and/or practice ammunition according to claim 4, wherein the drive is configured to receive the data via the communication interface.

6. The test and/or practice ammunition according to claim 1, wherein the projectile comprises an inert mass.

7. The test and/or practice ammunition according to claim 1, wherein the visible signal is a light and/or smoke signal.

8. The test and/or practice ammunition according to claim 1, wherein the projectile includes at least one separation point.

9. The test and/or practice ammunition according to claim 8, wherein the separation point is arranged between a fin and the projectile head.

10. The test and/or practice ammunition according to claim 8, wherein the separation point is arranged between a projectile base and the projectile ogive.

* * * * *